US005099915A

United States Patent [19]

VanDyke

[11] Patent Number: 5,099,915

[45] Date of Patent: Mar. 31, 1992

[54] HELICAL JET IMPINGEMENT EVAPORATOR

[75] Inventor: John M. VanDyke, Rockford, Ill.

[73] Assignee: Sundstrand Corporation, Rockford, Ill.

[21] Appl. No.: 510,186

[22] Filed: Apr. 17, 1990

[51] Int. Cl.[5] ..... F28F 3/00

[52] U.S. Cl. ..... 165/156; 165/166; 165/167

[58] Field of Search ..... 165/156, 164–167, 165/908

[56] References Cited

U.S. PATENT DOCUMENTS

| | | | |
|---|---|---|---|
| 2,703,701 | 3/1955 | Simpelaar | 165/141 |
| 3,865,185 | 2/1975 | Ostbo | 165/165 |
| 4,096,910 | 6/1978 | Coffinberry et al. | 165/81 |
| 4,347,897 | 9/1982 | Sumitomo et al. | 165/167 |
| 4,368,779 | 1/1983 | Rojey et al. | 165/165 |
| 4,494,171 | 1/1985 | Bland et al. | 361/386 |
| 4,624,305 | 11/1986 | Rojey | 165/165 |
| 4,645,001 | 2/1987 | Hillerstrom | 165/159 |
| 4,775,007 | 10/1988 | Sakuma et al. | 165/151 |
| 4,936,380 | 6/1990 | Niggemann | 165/167 |

*Primary Examiner*—Allen J. Flanigan

*Attorney, Agent, or Firm*—Antonelli, Terry, Stout & Kraus

[57] ABSTRACT

A helical jet impingement evaporator including a laminated evaporator core comprising a plurality of orifice plates (1) each including a plurality of jet impingement orifices (5) for enabling a passage of a first fluid therethrough on a single-phase side of the evaporator. A plurality of spacer plates (2) are interposed between adjacent orifice plates (1) and the orifice plates (1) and spacer plates (2) are stacked with adjacent orifice plates (1) and spacer plates (2) being offset with respect to each other in a circumferential direction. The orifice plate (1) include circumferentially and radially spaced elongate slots (7, 9, 11) in registry with elongated slots (8, 10, 14) in the spacer plates (2) so as to define separate helical two-phase evaporating flow paths for a second fluid on a two-phase side of the evaporator.

27 Claims, 4 Drawing Sheets

HELICAL JET IMPINGEMENT EVAPORATOR

TECHNICAL FIELD

The present invention relates to an evaporator and, more particularly, to a helical jet impingement evaporator for a vapor cycle refrigeration system used for cooling, for example, aircraft.

BACKGROUND ART

Evaporators for vapor cycle refrigeration systems used for cooling, for example, aircraft must be lightweight and insensitive to acceleration forces due to the motion of the aircraft.

While a number of evaporator constructions have been proposed and have been effective for achieving desired cooling results, a common problem of the proposed evaporator constructions resides in the overall size and weight of the systems necessary to achieve the desired cooling, both of which represent significant factors to be considered in constructing an evaporator for use in the aircraft industry.

In, for example, U.S. Pat. No. 4,347,897, a plate type heat exchanger is proposed wherein a heat exchange is effected between fluids through heat transfer plates, with the heat transfer plates serving as heat transfer elements and jet plates each having a number of small holes. One fluid is jetted through the small holes in the jet plates toward the heat transfer plates opposed to the jet plates while the other fluid flows along a respective opposite heat transfer surfaces or is jetted toward the respective opposite heat transfer surfaces in the same manner as the first fluid.

A disadvantage of the above noted proposed construction resides in the fact that the heat exchanger does not contain any extended surfaces and the jet plate does not contribute to the heat transfer. Moreover, the fluid exiting from the jets near the inlet passage interfere with the jets near the outlet passage thereby reducing the overall heat transfer rate.

U.S. Pat. No. 4,368,779 proposes a heat exchanger which includes stacked perforated sheets forming two series of channels for at least two fluids, with the distribution system being provided at each end and including a series of grooves communicating with an external duct and passages passing through a distribution plate and communicating with the external duct.

While the last mentioned proposed arrangement utilizes a plurality of stacked perforated plates for forming channels for hot and cold fluids, the proposed construction does not contemplate the use of jet impingement which is of extreme significance for the balancing of heat transfer on the single-phase side with that on an evaporating fluid of a two-phase side. Furthermore, in the proposed heat exchanger construction, turbulence is induced by the free edges at each level which does not enhance heat transfer in an evaporator structure wherein a transition between the respective plates must be made as soon as possible so that the liquid fill remains in contact with the walls.

An impingement cooling apparatus is proposed in U.S. Pat. No. 4,494,171, wherein jet impingement is used to cool a hot surface; however, this proposed arrangement relates to a single-phase side and is utilized to cool solid objects such as, for example, electronic components, laser mirrors, etc. not to evaporate another fluid in a helical flow passage adjacent to single-phase channels.

In, for example, U.S. Pat. No. 4,645,001, a heat exchanger is proposed utilizing perforated plates for distributing fluid and inducing jets on an external surface of tubes carrying a second fluid; however, the distribution plates, provided with spray holes, do not contribute to any heat transfer effects in the proposed heat exchanger.

Another form of a heat exchanger with staggered perforated plates is proposed in U.S. Pat. No. 4,624,305; however, the heat exchanger is not of a jet impingement type, nor does the patent address the use of the heat exchanger as an evaporator.

U.S. Pat. No. 4,775,007 also proposes a heat exchanger for an air conditioning apparatus which includes a plurality of regular corrugated fins placed in layers at regular pitches so as to form alternate wide and narrow fluid passages between adjacent corrugated fins, each passage having a plurality of small through holes.

DISCLOSURE OF THE INVENTION

The aim underlying the present invention essentially resides in providing an evaporator for vapor cycle refrigeration systems used for cooling on, for example, an aircraft which is simple in construction, dimensionally small, light in weight, and which is capable of providing heat transfer coefficients several times higher than conventional heat transfer surfaces for the same expenditure of fluid pumping power.

In accordance with advantageous features of the present invention, a helical jet impingement evaporator for vapor cycle refrigeration systems is provided wherein jet impingement is utilized on the single-phase side and a helical passage is utilized on a two-phase side of the evaporator. The helical flow on the two-phase side maintains the walls of the passages wet with the liquid phase thereby enhancing the heat transfer and also making the evaporator relatively insensitive to external accelerations or forces due to the motion of aircraft.

In accordance with advantageous features of the present invention, the helical jet impingement evaporator is of a laminated structure and is constructed of alternating layers of highly conductive orifice plates and spacer plates which are joined together to form a solid core. The orifice plates have a plurality of small holes which create fluid jets on the single phase side of the evaporator, with the small holes in each successive orifice plate being offset so that the fluid impinges on solid areas between the holes. Additionally, means are provided in the orifice plate in the form of, for example, solid areas between the plurality of small holes so as to create helical flow passages on the evaporating side of the heat exchanger.

Advantageously, means are provided in the orifice plate and spacer plates to index each successive plate as the plates are stacked to form the core, with the indexing forming the helical passages of a more or less spiral staircase fashion.

The specific configuration of the helical passages formed in the core of the helical jet impingement evaporator of the present invention as well as the pitch of the helical passages are determined by plate thickness, an angular position of the alignment means, as well as the length of slots formed in the orifice plate so as to create the helical flow passage on the evaporating side of the heat exchanger.

In accordance with the present invention, by virtue of the configuration and disposition of the orifice plate and spacer plates, extended heat transfer surfaces are provided which extended surfaces are necessary to provide compact heat exchangers since such surfaces provide large amounts of heat transfer surface areas in small packages. Furthermore, the provision of extended surfaces are important in balancing the heat transfer provided by each side of the heat exchanger and, on a single phase side of the helical jet impingement evaporator of the present invention, the jet plates and extended surfaces may be combined into a single orifice plate whereby the jet plates contribute significantly to the heat transfer.

Additionally, in accordance with the present invention, the laminated structure and offset holes in the orifice plates enable the fluid to cascade through the evaporator thereby precluding any interference between the jets near the inlet passageway and outlet passageway of the evaporator, thereby ensuring an overall high heat transfer rate.

Moreover, by virtue of the provision of a helical flow path for the two phase evaporating flow in accordance with the present invention, it is ensured that the passage walls are wet with the liquid phase thereby also enhancing the heat transfer and making the evaporator relatively insensitive to external forces.

By virtue of the utilization of a helical two-phase flow passage in accordance with the present invention, it is possible to create a secondary vapor flow composed of a counter-rotating vortex pair which tends to circulate the liquid from the outside wall to the inside wall of the passage thereby forming a thin annular film. For this purpose, a transition between the plates of the heat exchanger of the present invention is as smooth as possible so that the liquid film remains in contact with the walls.

Advantageously, in accordance with the present invention, the helical flow passages formed in the core of the evaporator have a substantially rectangular and, preferably, square cross-sectional configuration in a direction normal to a flow of the fluid thereby reducing stratification of the two phase flow.

The above and other objects, features, and advantages of the present invention will become more apparent from the following description when taken in connection with the accompanying drawings which show, for the purpose of illustration only, one embodiment in accordance with the present invention.

BEST MODE FOR CARRYING OUT THE INVENTION

Figure 1:
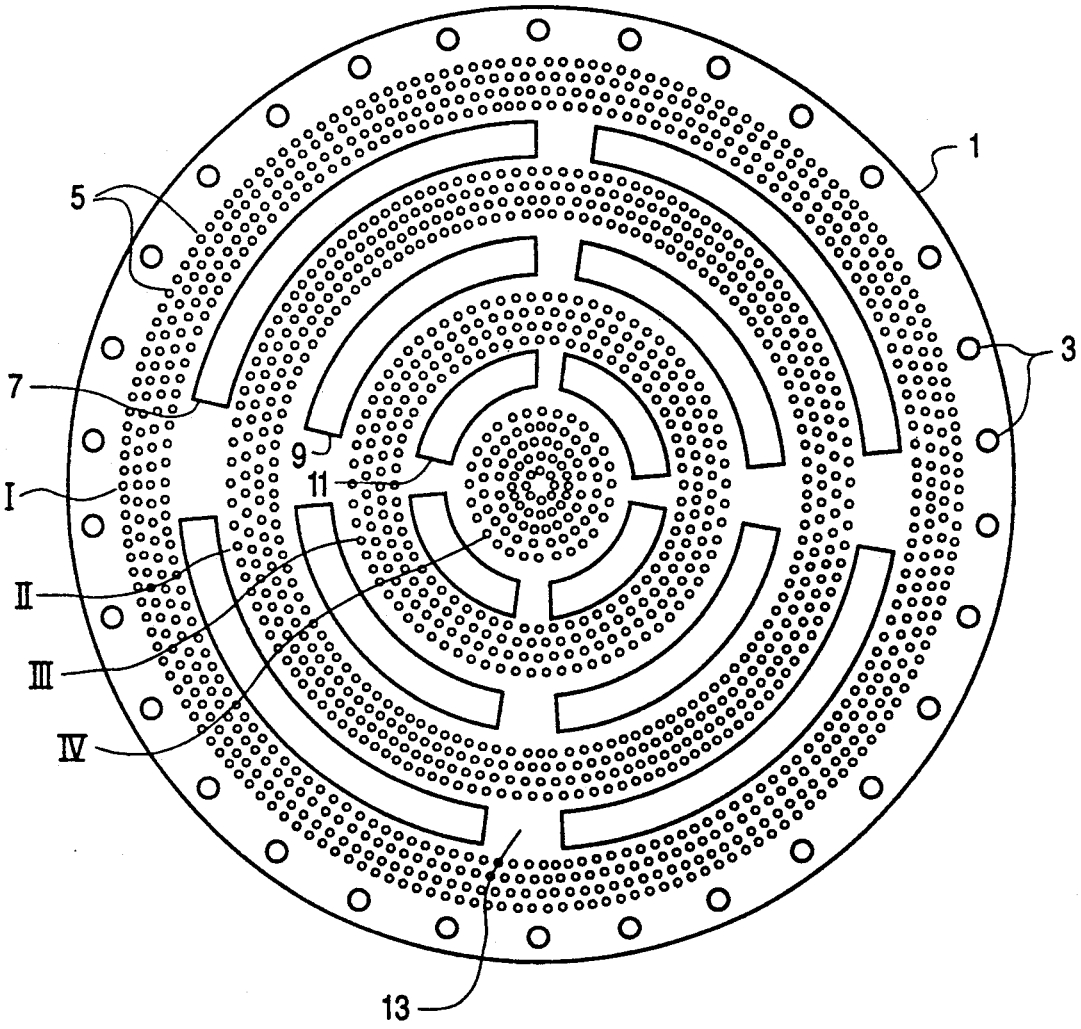
FIG. 1 is a top plan view of an orifice plate for a helical jet impingement evaporator constructed in accordance with the present invention.
Figure 2:
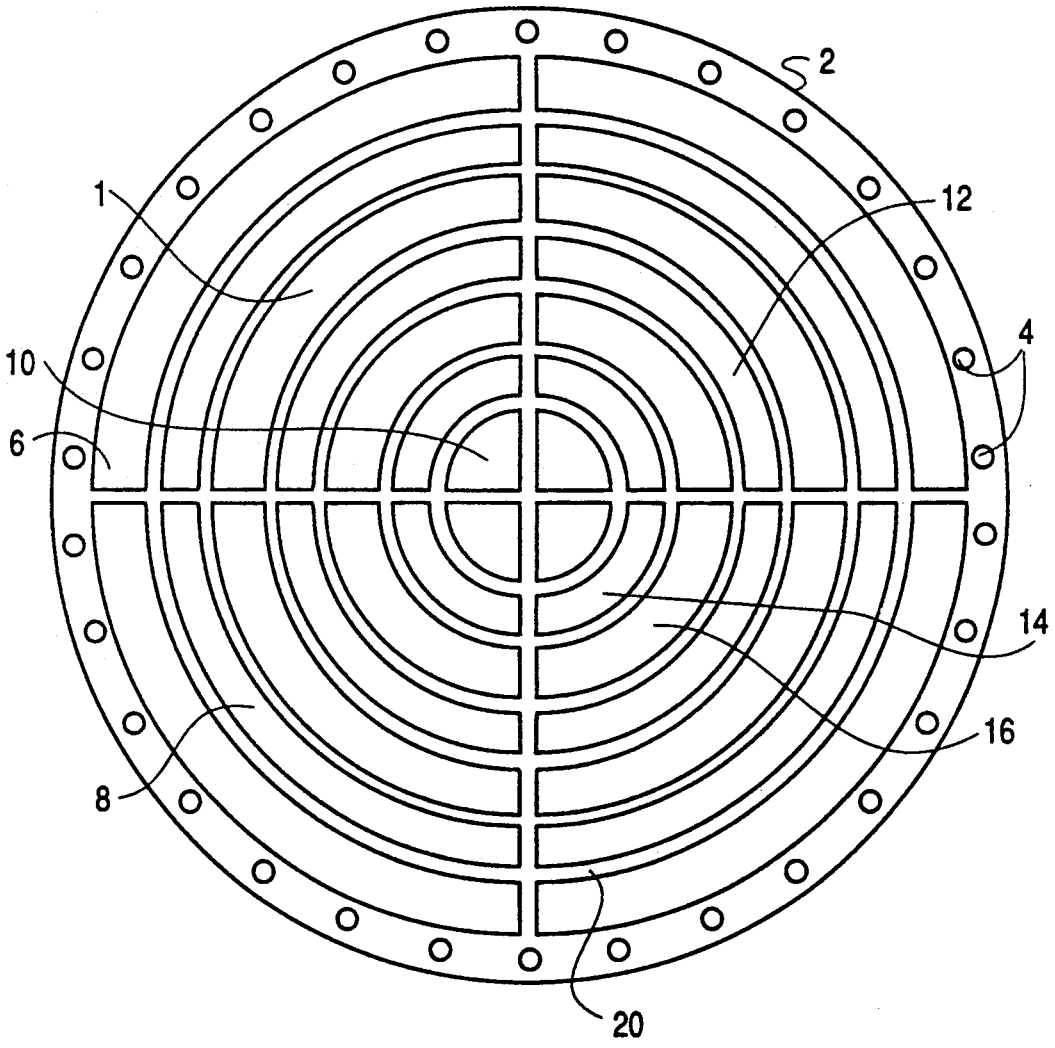
FIG. 2 is a top plan view of a spacer plate for a helical jet impingement evaporator constructed in accordance with the present invention.
Figure 3:
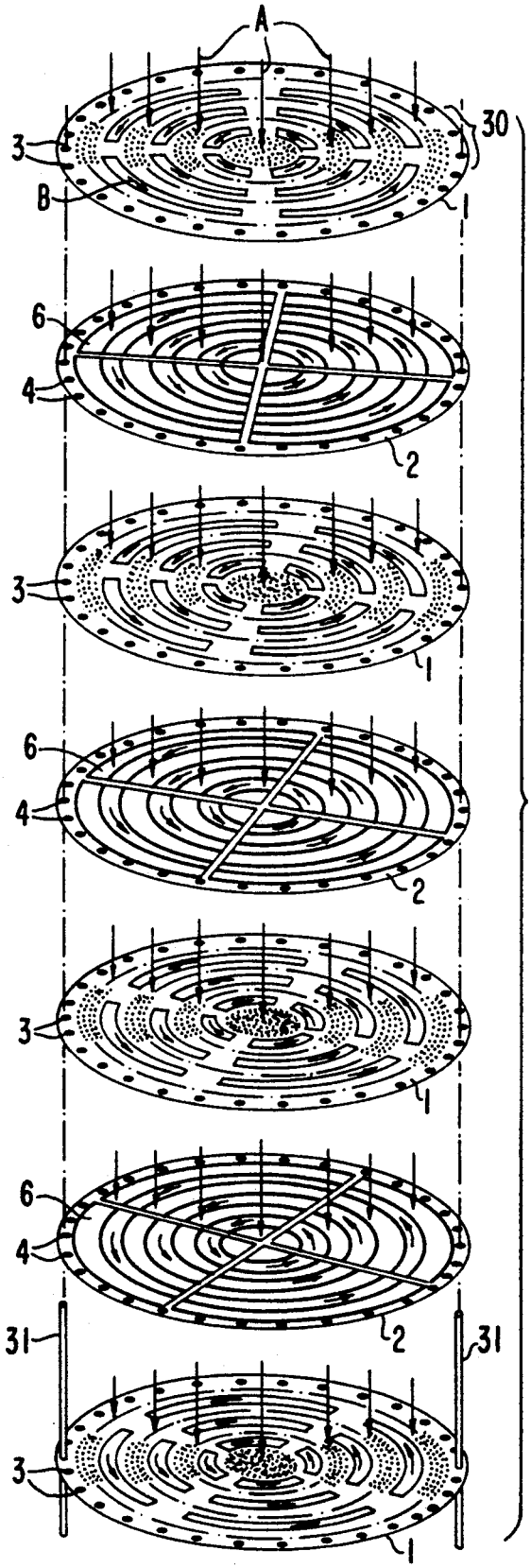
FIG. 3 is an exploded view of laminate stacking of the orifice plates and spacer plates of the helical jet impingement evaporator constructed in accordance with the present invention.

Referring now to the drawings wherein like reference numerals are used throughout the various views to designate like parts and, more particularly, to FIGS. 1–3, according to these figures, a helical jet impingement evaporator in accordance with the present invention includes a plurality of alternating layers of highly conductive orifice plates 1 and spacer plates 2 which are stacked so as to form a laminated solid core of the evaporator. The orifice plates 1 and spacer plates 2 are joined together to form the solid laminated core by, for example, brazing, diffusion bonding, gluing or any other suitable conventional method which ensures no leakage between adjacent slots 6, 8, 10, 12, 14, 16, 18 of the spacer plates 2.

As shown most clearly in FIG. 1, each orifice plate 1 includes a plurality of circumferentially spaced indexing openings or apertures 3 disposed along an outer peripheral portion thereof, with a plurality of jet impingement orifices or openings 5 disposed in concentric annular arrays I, II, III, IV. Each of the annular arrays of jet impingement orifices or openings 5 are separated by a plurality of concentric slot portions 7, 9, 11, with the respective slots being separated from each other by a solid or impermeable plate portion 14. The slot portions 7, 9, 11 are respectively circumferentially spaced from each other and disposed along respective common radii. The jet impingement orifices or openings 5 create fluid jets on a single phase side of the helical jet impingement evaporator of the present invention.

In the illustrated embodiment, the orifice plate 1 has twelve parallel helical passages or four starts at three radii resulting from the disposition of the slots 7, 9, 11 and the solid plate portions 13. The slots 7, 9, 11 create helical flow passages on the evaporating side of the heat exchanger. As can well be appreciated, the number of parallel helical passages to be created is determined by the particular application or use of the helical jet impingement evaporator. For example, a single slot portion 7, 9 or 11 may be disposed between the respective arrays I–II, II–III, or III–IV, or a single slot portion 7, 9 or 11 and only one array I, II, III, IV may be provided. Likewise, two or three slot portions 7, 9, 11 may also be provided between the respective arrays I, II, III, IV depending upon the desired cooling capacity of the evaporator.

As shown in FIG. 2, the spacer plate 2, in addition to the plurality of concentrically disposed slots or openings 6, 8, 10, 12, 14, 16, 18, separated from each other by solid or impermeable plate portions 20, also include a plurality of indexing openings or apertures 4 disposed about an outer peripheral portion thereof. When the spacer plates 2 are assembled or stacked alternately with the orifice plates 1, as shown most clearly in FIG. 3, the slots 6, 10, 16, 18 create or form open areas for the jets of fluid from the jet orifices or openings 5 of the orifice plate 1 to permit the jets to flow and impinge upon a successive orifice plate 1 in the stack, with the slots 8, 12, 14 being aligned with the slots 7, 9, 11 of the orifice plate 1 so as to form, when assembled into a core, parallel helical passages through the core of the helical jet impingement evaporator. Thus, the concentric slots or openings 8, 12, 14 function to separate the two sides of the heat exchanger. When the orifice plates 1 and the spacer plates 2 are assembled to form the evaporator core, the jet orifices or openings in each successive orifice plate 1 are offset so that the fluid from the jet orifices or openings 5 of one orifice plate impinges upon the solid areas between the jet orifices or openings 5 of a successive adjacent orifice plate 1.

To facilitate an indexing of the orifice plates 1 and spacer plates 2 during assembly of the core of the helical jet impingement evaporator, the indexing apertures or openings 3, 4 in the respective orifice plates and spacer plates 2 may be provided with suitable indicia 30 as shown in FIG. 3. As also shown in FIG. 3, during assembly of the core, suitable alignment pins 31 or the like are provided, with the alignment pins 31 being adapted to be received in the openings or apertures 3, 4 in the respective stacked orifice plates 1 and spacer plates 2. Moreover, since the orifice plates 1 and spacer plates 2 are indexed together, as can readily be appreciated, the features of the orifice plate 1 and spacer plate 2 could be incorporated into a single plate and, for example, the spacer plate 2 could be eliminated by the provision of suitably positioned protrusions or projections on the respective orifice plates 1.

Figure 4:
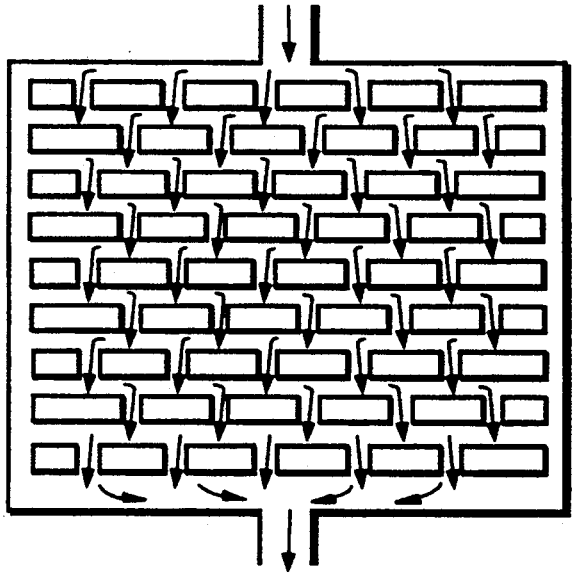
FIG. 4 is a schematic view depicting a jet fin-type heat exchange.
Figure 5:
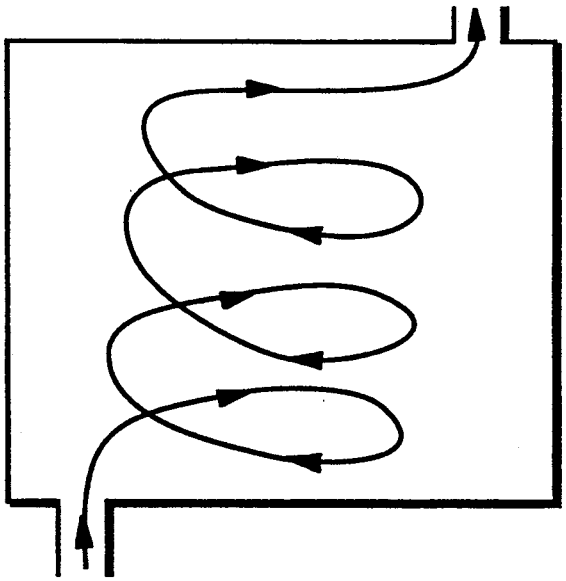
FIG. 5 is a schematic view depicting multiple start helical evaporation.

With the orifice plates 1 and spacer plates 2 assembled to form a laminated core of the helical jet impingement evaporator of the present invention, as shown most clearly in FIG. 3, a single phase jet flow is effected in a direction of the arrows A, with a two phase helical flow being effected in the direction of the arrows B. Thus, what is achieved by the construction of the present invention is a counterflow jet fin helical evaporator advantageously incorporating the benefits of a flow pattern such as shown in FIG. 4 achieved by a jet fin source with the advantages of the flow pattern shown in FIG. 5 achieved by virtue of a multiple start helical evaporation.

The slots provided in the orifice plates 1 and spacer plates 2 are generally rectangular and, approximately square, as viewed in a cross-section normal to a direction of flow, so as to reduce stratification of the two-phase flow. Moreover, a transition area between the respective orifice plates 1 and spacer plates 2 is as smooth as possible so that a liquid film remains in contact with walls of the helical passages thereby enhancing the heat transfer efficiency of the evaporator.

Moreover, the area of the helical passage away from the transition area between the respective orifice plates 1 and spacer plates 2 may be smooth or, if desired, one or more projections may be provided in such area to enhance the heat transfer efficiency by increasing the heat transfer surface area to which the fluid is exposed. The number of orifice plates 1 and spacer plates 2 may be either odd or even, with the total number being governed solely by the pressure drop of the fluid flowing through the evaporator core.

The present invention is well suited as an evaporator for air conditioning units of aircraft by virtue of the fact that it is extremely small and lightweight. Moreover, the helical jet impingement evaporator of the present invention provides a means for evaporating a fluid using a hot source fluid or sink fluid.

While I have shown and described only one embodiment in accordance with the present invention, it is understood that the same is not limited thereto but is susceptible to numerous changes and modifications as known to one of ordinary skill in the art, and I therefore do not wish to be limited to the details shown and described herein, but intend to cover all such modifications as are encompassed by the scope of the appended claims.

I claim:

1. A helical jet impingement evaporator including an evaporator core comprising a plurality of first plate means including a plurality of jet impingement orifices therein for enabling a passage of a first fluid therethrough on a single-phase side of the evaporator, said plurality of first plate means being disposed in a stacked fashion with the jet impingement orifices to adjacent first plate means being offset with respect to each other in a circumferential direction, and means for defining at least one helical two-phase evaporating flow path for a second fluid, wherein said at least one helical flow path is in a heat transfer relationship with said first fluid thereby permitting a heat exchange, and wherein said plurality of jet impingement orifices are disposed in the respective first plate means along at least one arcuate path, said means for defining includes at least one arcuate slot provided in each first plate means disposed in parallel to the arcuate path of the jet impingement orifices and radially spaced therefrom, said at least one arcuate slot in the respective first plate means are offset with respect to each other in such a manner so as to define at least one helical passage for the second fluid to permit the second fluid to flow through the core.

2. A helical jet impingement evaporator according to claim 1, wherein said means for defining further includes spacer means alternately disposed between said plurality of first plate means.

3. A helical jet impingement evaporator according to claim 2, wherein said spacer means includes a plurality of spacer plate means, each spacer plate means including at least one slot means disposed in registry with said arcuate path of the jet impingement orifices so as to define a free space permitting the first fluid to impinge on a succeeding first plate means in the core and at least one second slot means in registry of with said at least one arcuate slot in the respective first plate means, said spacer plate means being offset with respect to each other in correspondence with the offset of the respective first plate means thereby enabling the at least one arcuate slot in the respective first plate means and the at least one second slot means of the respective spacer plate means to define the at least one helical passage for the second fluid.

4. A helical jet impingement evaporator according to claim 3, wherein means are provided for facilitating an indexing of the first plate means at spacer plate means with respect to each other.

5. A helical jet impingement evaporator according to claim 4, wherein said means for facilitating includes a plurality of indexing aperture means disposed about an outer peripheral portion of the respective first plate means and respective spacer plate means in registry with each other and adapted to receive an alignment means.

6. A helical jet impingement evaporator according to claim 1, wherein at least two arcuate slots are provided in the respective first plate means, said at least two arcuate slots are circumferentially spaced from each other along the same radius and disposed in parallel to the at least one arcuate path of jet impingement orifices, and wherein said at least two arcuate slots are offset with respect to the corresponding arcuate slots in succeeding first plate means so as to define at least two helical passages for the second fluid to permit the second fluid to flow through the core.

7. A helical jet impingement evaporator according to claim 6, wherein at least one arcuate path of the impingement orifices extends about an entire outer peripheral portion of the respective first plate means, and said means for defining includes at least three arcuate slots provided in each of said first plate means circumferentially spaced from each other and disposed in parallel to the at least one arcuate path of the jet impingement orifices, and wherein said at least three arcuate slots are offset with respect to corresponding arcuate slots in succeeding first plate means so as to define at least three helical passages for the second fluid to permit the second fluid to flow through the core.

8. A helical jet impingement evaporator according to claim 7, wherein said means for defining further includes spacer means alternately disposed between said plurality of first plate means.

9. A helical jet impingement evaporator according to claim 8, wherein said spacer means includes a plurality of spacer plate means, each of said spacer plate means including a plurality of first slot means respectively disposed in registry with said at least one arcuate path of jet impingement orifices so as to define a free space permitting the first fluid to impinge on succeeding first plate means in the core and at least three second slot means respectively in registry with the at least three arcuate slots in the respective first plate means, and wherein said spacer plates are offset with respect to each other in correspondence with the respective first plate means thereby enabling the at least three arcuate slots in the respective first plate means and the at least three second slot means to define at least three helical passages for the second fluid.

10. A helical jet impingement evaporator including an evaporator core comprising a plurality of first plate means including a plurality of jet impingement orifices therein for enabling a passage of a first fluid therethrough on a single-phase side of the evaporator, said plurality of first plate means being disposed in a stacked fashion with the jet impingement orifices of adjacent first plate means being offset with respect to each other in a circumferential direction, and means for defining at least one helical two-phase evaporating flow path for a second fluid, wherein said at least one helical flow path is in a heat transfer relationship with said first fluid thereby permitting a heat exchange, and wherein said plurality of jet impingement orifices are disposed in the respective first plate means in at least two arrays respectively extending along radially spaced arcuate paths, said means for defining includes at least one arcuate slot provided in each first plate means and disposed between and in parallel with the radially spaced arcuate paths of the jet impingement apertures, said at least one arcuate slot in the respective first plate means are offset with respect to each other so as to define at least one helical passage for the second fluid to permit the second fluid to flow through the core.

11. A helical jet impingement evaporator according to claim 10, wherein said means for defining further includes spacer means alternately disposed between said plurality of first plate means.

12. A helical jet impingement evaporator according to claim 11, wherein said means for defining includes at least two arcuate slots provided in the respective first plate means, said at least two arcuate slots are circumferentially spaced from each other along the same radius and disposed in parallel to the at least two arrays of jet impingement orifices, said at least two arcuate slots are offset with respect to corresponding arcuate slots in succeeding first plate means so as to define at least two helical passages for the second fluid to permit the second fluid to flow through the core.

13. A helical jet impingement evaporator according to claim 12, wherein said at least two arrays respectively form complete radially spaced rings of jet impingement orifices in the respective first plate means, said means for defining includes at least three arcuate slots provided in each of said first plate means circumferentially spaced from each other and disposed in parallel and between the radially spaced rings of the jet impingement orifices, and wherein said at least three arcuate slots are offset with respect to corresponding arcuate slots in succeeding first plate means so as to define at least three helical passages for the second fluid to permit the second fluid to flow through the core.

14. A helical jet impingement evaporator according to claim 13, wherein said spacer means includes a plurality of spacer plate means, each of said spacer plate means including a plurality of first slot means respectively disposed in registry with the arrays of the jet impingement orifices so as to define a free space for permitting the first fluid to impinge upon succeeding first plate means in the core and at least three second slot means respectively in registry with the at least three arcuate slots in the respective first plate means, and wherein said spacer plates are offset with respect to each other in correspondence with the respective first plate means thereby enabling the at least three arcuate slots in the respective first plate means and the at least three second slot means to define the at least three helical passages for the second fluid.

15. A helical jet impingement evaporator including an evaporator core comprising a plurality of first plate means including a plurality of jet impingement orifices therein for enabling a passage of a first fluid therethrough on a single-phase side of the evaporator, said plurality of first plate means being disposed in a stacked fashion with the jet impingement orifices of adjacent first plate means being offset with respect to each other in a circumferential direction, and means for defining at least one helical two-phase evaporating flow path for a second fluid, wherein said at least one helical flow path is in a heat transfer relationship with said first fluid thereby permitting a heat exchange, and wherein said plurality of jet impingement orifices are disposed in the respective first plate means in at least three arrays respectively extending along radially spaced arcuate paths, said means for defining includes at least one first arcuate slot provided in each of the first plate means and disposed between and in parallel with the first and second of said three arrays and at least one second arcuate slot provided in each of said first plate means disposed between and in parallel with the second and third of said three arrays, said at least one first and said at least one second arcuate slots in the respective first plate means so as to respectively form at least two helical passages for the second fluid between the respective arrays of jet impingement orifices.

16. A helical jet impingement evaporator according to claim 15, wherein said means for defining includes at least two first arcuate slots provided between the respective first plate means circumferentially spaced from each other and disposed along the same radius and at least two second arcuate slots provided in a respective first plate means circumferentially spaced from each other and disposed along the same radius, said at least two first arcuate slots being disposed between and in parallel to the first and second of said three arrays and said at least two second arcuate slots being disposed between and in parallel with the second and third arrays, said at least two second arcuate slots in a respective first plate means being offset with respect to corresponding first and second arcuate slots in succeeding first plate means so as to respectively form at least two helical passages for the second fluid between the respective arrays of the jet impingement orifices.

17. A helical jet impingement evaporator according to claim 16, wherein said means for defining further includes spacer means alternately disposed between said plurality of first plate means.

18. A helical jet impingement evaporator according to claim 17, wherein said spacer means includes a plurality of spacer plate means, each of said spacer plate means including a plurality of first slot means respectively disposed in registry with the at least three arrays of jet impingement orifices so as to define a free space permitting the first fluid to impinge on succeeding first plate means in the core and at least two second slot means respectively in registry with the at least two second arcuate slots in the respective first plate means, and wherein said spacer plate means are offset with respect to each other in correspondence with the respective first plate means thereby enabling the at least two arcuate slots in the respective first plate means and the at least two second slot means in the spacer plate means to define at least two helical passages for the second fluid.

19. A helical jet impingement evaporator including an evaporator core comprising a plurality of first plate means including a plurality of jet impingement orifices therein for enabling a passage of a first fluid therethrough on a single-phase side of the evaporator, said plurality of first plate means being disposed in a stacked fashion with the jet impingement orifices of adjacent first plate means being offset with respect to each other in a circumferential direction, and means for defining at least one helical two-phase evaporating flow path for a second fluid, wherein said at least one helical flow path is in a heat transfer relationship with said first fluid thereby permitting a heat exchange, and wherein said plurality of jet impingement orifices are disposed in the respective first plate means in at least four arrays, a first of said four arrays being disposed substantially centrally of the respective first plate means and the remaining arrays being arranged as three concentrically disposed radially spaced rings of jet impingement orifices, said means for defining includes at least one arcuate slot provided in each plate means between the first and second, second and third, and third and fourth of said arrays of jet impingement orifices, said at least one slot being disposed in parallel to the concentric rings of the jet impingement orifices and being offset with respect to corresponding slots and succeeding first plate means so as to respectively form at least one helical passage for the second fluid between the respective arrays of jet impingement apertures.

20. A helical jet impingement evaporator according to claim 19, wherein said means for defining includes at least two arcuate slots circumferentially spaced from each other, arranged along the same radius, and disposed between the respective arrays of jet impingement orifices so as to form at least two helical passages for the second fluid between the respective arrays of the jet impingement orifices.

21. A helical jet impingement evaporator according to claim 19, wherein said means for defining include at least three arcuate slots circumferentially spaced from each other, arranged along the same radius, and disposed between the respective arrays of jet impingement orifices so as to form at least three helical passages for the second fluid between the respective arrays of jet impingement orifices.

22. A helical jet impingement evaporator according to claim 19, wherein said means for defining includes at least four arcuate slots circumferentially spaced from each other, arranged along the same radius, and disposed between respective arrays of the jet impingement orifices so as to form at least four helical passages for the second fluid between the respective arrays of the jet impingement orifices.

23. A helical jet impingement evaporator according to claim 22, wherein said means for defining further includes spacer means alternately disposed between said plurality of first plate means.

24. A helical jet impingement evaporator according to claim 23, wherein said spacer means includes a plurality of spacer plate means, each spacer plate means including a plurality of first slot means respectively disposed in registry with the respective arrays of jet impingement orifices so as to define a free space permitting the first fluid to impinge on succeeding first plate means in the core and at least four second slot means respectively in registry with the at least four arcuate slots in the respective first plate means, and wherein said spacer plate means are offset with respect to each other in correspondence with the respective first plate means thereby enabling the at least four arcuate slots in the respective first plate means and the at least four second slot means of the spacer plate means to define the at least four helical passages for the second fluid.

25. A helical jet impingement evaporator including an evaporator core comprising a plurality of first plate means including a plurality of jet impingement orifices therein for enabling a passage of a first fluid therethrough on a single-phase side of the evaporator, said plurality of first plate means being disposed in a stacked fashion with the jet impingement orifices of adjacent first plate means being offset with respect to each other in a circumferential direction, and means for defining at least one helical two-phase evaporating flow path for a second fluid, wherein said at least one helical flow path is in a heat transfer relationship with said first fluid thereby permitting a heat exchange, the plurality of radially spaced arrays in the respective first plate means, and wherein said means for defining includes means disposed between the spaced arrays forming at least two separate helical passages for the second fluid between each of the arrays.

26. A helical jet impingement evaporator including an evaporator core comprising a plurality of first plate means including a plurality of jet impingement orifices therein for enabling a passage of a first fluid therethrough on a single-phase side of the evaporator, said plurality of first plate means being disposed in a stacked fashion with the jet impingement orifices of adjacent first plate means being offset with respect to each other in a circumferential direction, and means for defining at least one helical two-phase evaporating flow path for a second fluid, wherein said at least one helical flow path is in a heat transfer relationship with said first fluid thereby permitting a heat exchange, the plurality of jet impingement orifices are disposed in a plurality of radially spaced arrays in the respective first plate means, and wherein said means for defining includes means disposed between the spaced arrays forming at least three separate helical passages for the second fluid between each of the arrays.

27. A helical jet impingement evaporator including an evaporator core comprising a plurality of first plate means including a plurality of jet impingement orifices therein for enabling a passage of a first fluid therethrough on a single-phase side of the evaporator, said plurality of first plate means being disposed in a stacked fashion with the jet impingement orifices of adjacent first plate means being offset with respect to each other in a circumferential direction, and means for defining at least one helical two-phase evaporating flow path for a second fluid, wherein said at least one helical flow path is in a heat transfer relationship with said first fluid thereby permitting a heat exchange, the plurality of jet impingement orifices are disposed in a plurality of radially spaced arrays in the respective first plate means, and wherein said means for defining includes means disposed between the spaced arrays forming at least four separate helical passages for the second fluid between each of the arrays.

* * * * *